US006286355B1

(12) United States Patent
Figge et al.

(10) Patent No.: US 6,286,355 B1
(45) Date of Patent: Sep. 11, 2001

(54) ROLLING MILL WITH WORKING ROLLERS AND MULTIPART SUPPORT ROLLERS

(75) Inventors: Dieter Figge, Essen; Wilhelm Schwerdt, Alpen, both of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/622,495

(22) PCT Filed: Feb. 17, 1999

(86) PCT No.: PCT/DE99/00499

§ 371 Date: Aug. 17, 2000

§ 102(e) Date: Aug. 17, 2000

(87) PCT Pub. No.: WO99/41025

PCT Pub. Date: Aug. 19, 1999

(30) Foreign Application Priority Data

Feb. 17, 1998 (DE) ..... 198 07 601

(51) Int. Cl.[7] ..... B21B 29/00
(52) U.S. Cl. ..... 72/241.4; 72/252.5
(58) Field of Search ..... 72/241.2, 241.4, 72/252.5

(56) References Cited

U.S. PATENT DOCUMENTS 5,943,895 * 8/1999 Lemper ..... 72/241.4

FOREIGN PATENT DOCUMENTS 1-18512 * 1/1989 (JP) ..... 72/241.4
3-248704 * 11/1991 (JP) ..... 72/241.4
6-39409 * 2/1994 (JP) ..... 72/241.4
6-154808 * 6/1994 (JP) ..... 72/241.4

* cited by examiner

*Primary Examiner*—Ed Tolan
(74) *Attorney, Agent, or Firm*—Cohen, Pontani, Lieberman & Pavane

(57) ABSTRACT

A rolling mill with working rolls and with multipart support rolls. The rolling mill includes of a basic body with a plurality of rolling bearings which are arranged next to one another on the basic body in its longitudinal direction. The outer rings of the bearing rotatably support a sleeve which surrounds the rolling bearings and bears with its inner surface, all-round, on the outer surfaces of the outer rings of the rolling bearings and the outer surface of which forms the roll barrel of the support roll. Three rolling bearings, of which the middle rolling bearing is designed as a tapered rolling bearing, are provided over the length of the basic body. In this case the two outer rolling bearings are designed as cylindrical roller bearings and an eccentric bush motively rotatable about the longitudinal axis of the basic body is arranged between the two cylindrical roller bearings and the basic body.

7 Claims, 1 Drawing Sheet

ROLLING MILL WITH WORKING ROLLERS AND MULTIPART SUPPORT ROLLERS

BACKGROUND OF THE INVENTION

1. Field of the Invention

The invention relates to a rolling mill with working rolls and with multipart support rolls, said rolling mill consisting of a basic body with a plurality of rolling bearings which are arranged next to one another on the basic body in its longitudinal direction and with their outer rings rotatably support a sleeve which surrounds the rolling bearings and bears with its inner surface, all-round, on the outer surfaces of the outer rings of the rolling bearings and the outer surface of which forms the roll barrel of the support roll. Three rolling bearings, of which the middle rolling bearing is designed as a tapered roller bearing, are provided over the length of the basic body.

2. Discussion of the Prior Art

A rolling mill of this type is known from U.S. Pat. No. 1,910,158.

In present-day hot strip mills, profile and planeness control plays an important part. In this case, the negative and positive flexion of the working rolls is the "classic" actuator which, even under rolling load, allows variation. However, since the work has to be carried out, taking into account a wide variety of parameters, such as width, thickness, cross-sectional profile, material, rolling temperature, rolling speed, roll temperature and steel qualities, it is important, in the case of small batch sizes which are common nowadays and with rolling mills of universal use, to have a wide actuating range available.

In recent years, further actuators have been employed to an increased extent in new mills, the best known being the barrel contour, known as the CVC ground roll section, and the roll crossing, the crossing of the working and/or support rolls. Neither solution is optimal, because, in both methods, the rolls cannot be adjusted under load. Furthermore, the contouring of the rolls with complicated CVC ground sections has to be carried out with extreme accuracy, in order to achieve the desired geometry. Often, under particular conditions, the rolling stock undergoes different deformation at the edge and in the middle. In a continuous mill, a roll with a defined barrel contour is necessary, which is different on each stand.

In roll crossing, that is to say when the rolls of a pair of rolls are inclined relative to one another, special measures are necessary in order to achieve uniform angular speeds for a given pivoting angle. Thus, normal cardan shafts cannot be used, but, instead, toothed spindles are necessary for driving the rolls. Furthermore, pivoting generates very high axial forces which may amount to 10% of the radial rolling force. Moreover, roll crossing leads to problems in the guidance of the rolling stock, because the rolling stock rotates in the roll stand.

In the search for a further actuator which avoids the disadvantages described and is simple, support rolls with eccentrics have been developed, which are used with a sleeve of adjustable profile as an additional actuator for profile control. Thus, European patent specification 0,584,642 describes a rolling mill of the generic type, in which the round body, designated there as a roll shaft, is divided into five or more sections which are arranged eccentrically to the central axis passing through the roll shaft. The sections of the roll shaft, because of their offset, have eccentrically arranged on them support bearings in the form of tapered roller bearings, against which the cylindrical sleeve, which surrounds the rolling bearings loosely with play, can be pressed. The cylindrical portions of the sections of the roll shaft which are proposed there have different diameters which, however, are uniformly graduated symmetrically to the middle of the support roll.

During the rolling operation, the sleeve rolls, with respect to the mounting of the support roll, between the working roll and the rolling bearing outer rings facing the working roll. On the side facing away from the working roll, the sleeve runs freely without contact with the bearings. By the rotation of the roll shaft, the flexion line of the working roll can be influenced, because the effective eccentricity between the support roll and the working roll is varied. Action can thereby be taken on the profile of the roll nip in the roll stand.

A disadvantage of the known solution is that the flexing movement of the outer sleeve of the support roll between the bearings of the support roll and the working roll does not have any stability under high rolling loads. On the other hand, due to the necessary play between the sleeve and the rolling bearings of the support roll, use as the lower support roll in a hot roll stand is not possible or is possible only with great difficulty, since effective protection of the mounting against water and dirt can hardly be achieved on a permanent basis. Moreover, due to the fact that the rolling bearing outer rings come to bear only partially, the flexing movements between the sleeve and the bearing lead to marked wear phenomena which adversely influence the adjustability of the rolling mill and therefore the quality of the rolled product. Also, for the reasons mentioned, there has hitherto been no known application of a generic support roll.

Another problem of known eccentric support rolls is the mounting between the basic body and the sleeve, since the bearings have to transmit the entire rolling force. The self-aligning roller bearings provided are subjected to extremely high load and it is difficult to achieve the required service life of approximately 6,000 hours. The service life of the bearings is additionally reduced due to the eccentric adjustment between the sleeve and the basic body.

In addition, during eccentric adjustment without any rolling load, the sleeve of the support roll is deformed to an extent such that it acquires a basic convex or neutral shape. In the convex position, the self-aligning roller bearings are tilted, so that their service life is reduced even further.

Finally, in the known eccentric support roll designs, the sleeve is extremely difficult to mount, because it has to be pushed over the projecting parts of the eccentric mounting.

SUMMARY OF THE INVENTION

The object of the present invention is, proceeding from known eccentrically adjustable support rolls, to improve their design in such a way that, along with reduced production costs, a substantially longer service life of the components subject to wear can be expected and, as a result of the simplified design, it becomes easier for the sleeve to be mounted and demounted on the rolling bearings.

This object is achieved by means of the features of patent claim 1.

The essence of the present invention is that an eccentric adjustment of the middle region of the support roll is dispensed with, and, instead, only the two edge regions of the support roll are deformed by eccentric adjustment and, at the same time, simple cylindrical roller bearings are adopted, which are paired with eccentric bushes rotatable on the basic body. Cylindrical roller bearings have distinct advantages over self-aligning roller bearings. Thus, self-aligning roller bearings are manufactured with less accuracy, so that, in known eccentric support rolls with a multiplicity of self-aligning roller bearings, uniform support cannot easily be achieved. With cylindrical roller bearings, axial displacement of the rolling bodies on the rings of the order of magnitude of 1% during one revolution is permitted, which allows a more favorable setting than is possible with selfaligning roller bearings. Moreover, cylindrical roller bearings are more advantageous in manufacturing terms and are therefore cheaper.

In a refinement of the proposal according to the invention, there is provision for each eccentric bush to be assigned a continuously variable pivoting drive and for the two pivoting drives to be capable of being synchronized. Continuous adjustment of the sleeve elevation in the edge region is thereby possible.

According to a further proposal of the invention, there is provision for the basic body to be fixed nonrotatably in the stand column. Complicated rotary drives for the basic body are dispensed with in this solution, because the adjustment of the support roll or of the sleeve with respect to the basic body is carried out via the separate pivoting drives of the eccentric bushes and no longer by the rotation of the basic body, as in the prior art. The basic body consequently always remains in a neutral position, and the rolling force is always transmitted in one and the same position to the stand via the bearing blocks.

According to a particularly beneficial feature of the invention, there is provision for providing in the load region of the basic body, between the latter and the eccentric bush, in each case a self-adjustable tilting segment allowing the skewing of the cylindrical roller bearing. By means of this tilting segment, a particularly favorable load distribution to the cylindrical roller bearing and consequently an appreciable increase in service life are achieved. In the case of the cylindrical roller bearing with a tilting segment, the bearing inner rings are deformed, this being more advantageous than the inclination of the outer rings in the case of the self-aligning roller bearing, which leads to the distortion of the raceway. The tilting segment gives rise, in the load region of the support roll, to a deformation of the rolling bearing rings. In the case of a varying deflection of the tilting segment, the force can be conducted reliably via the tilting segment into the basic body. Admittedly, at the transition from the tilting segment to the normal nondeformably supported raceway, the ring is rotated somewhat. However, since this takes place in a region without any roll load, where only a few rollers provide support, while the others are nonloaded, this has no harmful effect.

In one refinement, the tilting segment is designed to be convex in the longitudinal direction of the basic body and consists of a sliding bearing material which is capable of being relieved hydrostatically. The hydrostatic relief ensures that the high rolling forces do not block the adjustability of the roll, even under load.

In a further advantageous refinement of the invention, there is provision for the eccentric bushes to be slideably guided rotatably on eccentric surfaces of the basic body, the eccentricity of said eccentric surfaces making it possible, in a neutral rotary position of the eccentric bushes, to align the eccentric axes with the longitudinal axis of the basic body. This affords a neutral position of the eccentric bush in which there is no offset between the axes. This position is used for drawing on the sleeve. The rotation of the eccentric bushes brings about an offset of approximately 2 mm, and rolling is carried out in this position.

According to a further feature of the invention, there is provision for flattening the basic body in its two edge regions. This is intended to ensure that the eccentric bushes and the rolling bearing rings can expand when the casing is skewed. The flattenings may be carried out by milling off the basic body locally on the circumference, laterally on the basic body, in planes parallel to the rolling plane.

In order to allow the tiltability of the rolling bearings in the no-load region, it is proposed, according to a further feature of the invention, that that region of the basic body which is located opposite the tilting segments be beveled in a roof-shaped manner in the longitudinal direction locally on the circumference, the bevels running from the center of the rolling bearing inner rings toward both sides. The eccentric bush and the rolling bearings can be skewed as a result of this measure; on the side facing away from the load region, this solution is simpler than a further tilting segment and does not weaken the cross section of the basic body subjected to flexion load.

Since relative movement between highly loaded surfaces takes place between the contact surfaces of the eccentric bushes and the eccentric surfaces of the basic body during setting, that is to say during the rotation of the eccentric bushes, according to a further feature of the invention this contact region is to be capable of being relieved hydrostatically. Ease of movement of the adjusting mechanism is thereby achieved, which makes it possible to set and adjust the sleeves under load.

An essential advantage of the present invention is its simplicity. It makes it possible, without any problem, to use standard rolling bearings for the sleeve surrounding the rolling bearings, with the result that the disadvantages described are avoided and a cost-effective solution is provided. The basic body, together with the eccentric bushes and their adjusting drives, is suitable for long-term use, and only the sleeve, as a wearing part, has to be renewed after being ground down.

BRIEF DESCRIPTION OF THE DRAWINGS

An exemplary embodiment of the invention is illustrated in the drawing and is described below. In the drawing.

DETAILED DESCRIPTION OF THE PREFERRED EMBODIMENTS

Figure 1:
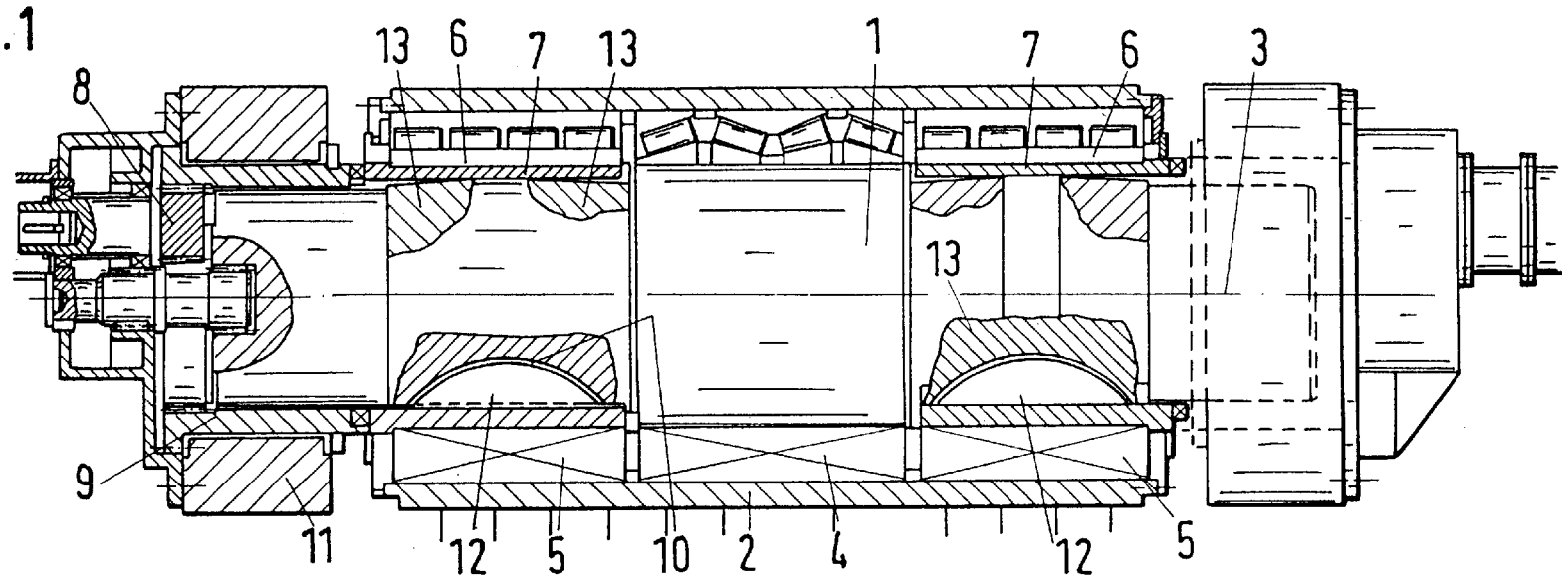
FIG. 1 shows a longitudinal section through the support roll according to the invention.

FIG. 1 illustrates the support roll according to the invention in longitudinal section. It consists essentially of the basic body 1, on which the sleeve 2 is mounted rotatably about the longitudinal axis 3 of the basic body 1. For this purpose, three rolling bearings are arranged between the basic body 1 and the sleeve 2, of which the middle rolling bearing is designed as a double tapered roller bearing 4 and the two rolling bearings arranged on both sides of this are designed as cylindrical roller bearings 5. While the tapered roller bearing 4 sits directly on the basic body 1, an eccentric bush 7 is arranged rotatably with respect to the basic body 1 between the inner rings 6 of the cylindrical roller bearings 5 and the circumferences of the basic body 1 in each case in the edge regions of the basic body 1. The eccentric bushes 7 are driven in rotation independently of one another, but so as to be capable of being synchronized, for which purpose a spur gear 8 with a drive (not illustrated) is provided in each case. The said spur gear engages by means of an externally toothed pinion in each case into the internal toothing of a rotary sleeve 9 which is mounted rotatably on the basic body ends and which positively engages on the end face into each of the two eccentric bushes 7 and rotates these. The basic body 1 is fixed nonrotatably via a circumferentially toothed journal 10; the journal 10 is supported on the installation piece 11, in which the basic body 1 is received in the stand frame.

On that side of the support roll which faces the rolling stock, a recess is milled into the basic body 1 on both sides of the tapered roller bearing 4, a tilting segment 12 assigned to each cylindrical roller bearing 5 being inserted into said recess. The tilting segment 12 is designed to be convex in the longitudinal direction of the basic body 1 and, on its side facing away from the barrel 13 and corresponding essentially to the outer circumference of the basic body 1, carries the eccentric bushes 7, on which the inner rings 6 of the cylindrical roller bearing 5 are supported. When the eccentric bushes 7 are rotated, a flexural force is applied to the sleeve 2 of the support roll and leads to a convex or concave deformation of the sleeve 2. So that the cylindrical roller bearings are not damaged by these eccentrically acting flexural forces, each tilting segment 12 allows a sufficient inclination of the cylindrical roller bearings 5, in that the tilting segments are slideably adjusted obliquely via their barrels 13.

So that the inner ring region of the cylindrical roller bearing 5 which faces away from the load side is not exposed to great constraints, the regions of the basic body 1 which are located opposite the tilting segments 12 are beveled in a roof-shaped manner locally on the circumference in the longitudinal direction of the basic body 1, the bevels starting from the middle region of the cylindrical roller bearing 5 and running toward both sides. The bevels are made plane and run only over a circumferential portion of the basic body 1 (see FIG. 2).

Figure 2:
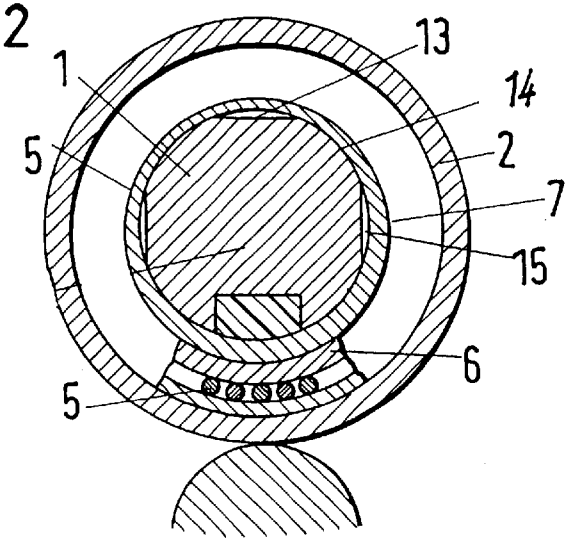
FIG. 2 shows a cross section through the support wall according to FIG. 1 in the region of the tilting segment, in the installation position of the sleeve.

It can be seen in FIG. 2 that plane bevels, which are designated by 15, are also provided, parallel to the rolling plane, on the outer circumference of the basic body 1 in side regions of the latter. These bevels allow a slight expansion of the eccentric bush 7 and of the inner ring 6 in the load direction, which may occur during the inclination of the sleeve 2 with respect to the basic body 1. Since, according to the invention, eccentric surfaces are likewise formed on the basic body 1 in the supporting region of the eccentric bush 7, the eccentricity of said eccentric surfaces corresponding to that of the eccentric bushes, it is possible, by the appropriate rotation of the eccentric bush 7 on the eccentric surfaces designated by 14, to set a neutral position, in which the sleeve 2 is not subjected to any flexion and therefore the sleeve can be mounted and demounted in this position. This position is illustrated in FIG. 2.

Figure 3:
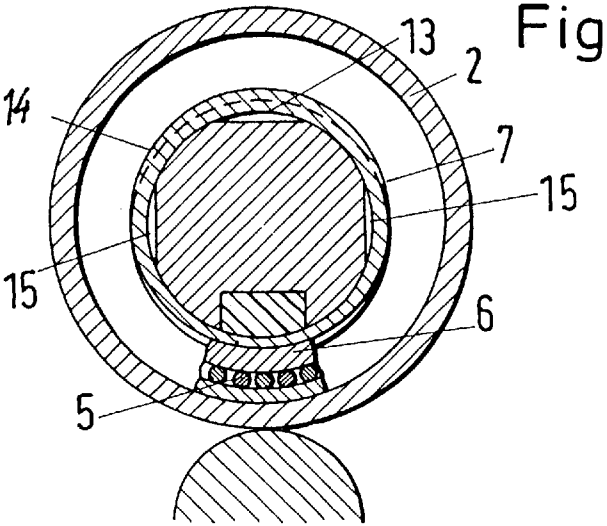
FIG. 3 shows the cross section according to FIG. 2 in an extreme position of the eccentric.

In FIG. 3, the eccentric bush 7 has been rotated through 180°, so that the full flexural action of the eccentric on the sleeve 2 takes effect. In this position, the support roll has the greatest adjustable convexity which can be varied continuously between this position and the neutral position.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

What is claimed is:

1. A rolling mill, comprising a working roll and a multipart support roll, the support roll including a basic body with a plurality of rolling bearings which are arranged next to one another on the support roll in a longitudinal direction of the support roll, the rolling bearings having outer rings, a sleeve being rotatably supported on the outer rings so as to surround the rolling bearings, the sleeve having an inner surface that bears, all-round, on an outer surface of the outer rings of the rolling bearings, an outer surface of the sleeve forming a roll barrel of the support roll, the rolling bearings including three rolling bearings arranged as a middle rolling bearing and two outer rolling bearings, the middle rolling bearing being a tapered roller bearing provided over a length of the basic body, the two outer rolling bearings being cylindrical roller bearings, an eccentric bush motively rotatable about a longitudinal axis of the basic body being arranged in each case between the two cylindrical roller bearings and the basic body, a self-adjustable tilting segment operative to allow skewing of the cylindrical roller bearing being provided in a load region of the basic body between the basic body and each eccentric bush.

2. A rolling mill as defined in claim 1, and further comprising a continuously variable pivoting drive respectively assigned to each eccentric bush, the two pivoting drives being syncrhonizable.

3. A rolling mill as defined in claim 1, and further comprising a stand column, the basic body being fixed nonrotatably in the stand column.

4. A rolling mill as defined in claim 1, wherein the tilting segment is convex in the longitudinal direction of the basic body and consists of a sliding bearing material which is capable of being relieved hydrostatically.

5. A rolling mill as defined in claim 1, wherein the basic body has eccentric surfaces on which the eccentric bushes are slideably guided rotatably.

6. A rolling mill as defined in claim 1, wherein a region of the basic body which is located opposite the tilting segments is convex in the longitudinal direction locally on the circumference so as to form barrels that run from a center of inner rings of the rolling bearings toward both sides.

7. A rolling mill as defined in claim 1, wherein the basic body has eccentric surfaces arranged so that a contact region between the eccentric bushes and the eccentric surfaces of the basic body is hydrostatically relievable.

* * * * *